United States Patent [19]

Cotey

[11] Patent Number: 4,701,148

[45] Date of Patent: Oct. 20, 1987

[54] FILLING VALVE FOR USE IN FILLING BALLOONS

[76] Inventor: John Cotey, 27 West End Ave., Haddonfield, N.J. 08033

[21] Appl. No.: 881,323

[22] Filed: Jul. 2, 1986

[51] Int. Cl.[4] ..... A63H 3/06

[52] U.S. Cl. ..... 446/224; 137/223; 137/853

[58] Field of Search ..... 137/223, 853; 446/220, 446/224

[56] References Cited

U.S. PATENT DOCUMENTS 3,616,569 6/1969 Litt ..... 446/220
4,512,514 4/1985 Eleott ..... 137/853 X

FOREIGN PATENT DOCUMENTS 820514 11/1951 Fed. Rep. of Germany ..... 137/853

*Primary Examiner*—Harold W. Weakley
*Attorney, Agent, or Firm*—Eugene E. Renz, Jr.

[57] ABSTRACT

A valve assembly for filling balloons comprising an elongated generally tubular body member having an upper section and a lower section divided by a transverse interior wall, a radially outwardly directed flange defining a circumferentially extending channel for the bead at the mouth of a balloon, means defining at least one outlet port in the sidewall of the lower section and at least one opening in the side wall of the upper section spaced downwardly from the upper terminal edge thereof.

3 Claims, 6 Drawing Figures

FILLING VALVE FOR USE IN FILLING BALLOONS

FIELD OF THE INVENTION

The present invention relates generally to balloons, and more specifically to a one-way valve to facilitate inflating the balloons through the valve.

BACKGROUND OF THE INVENTION

Balloon assemblies and valves of the type to which the present invention pertain are not new per se. A typical assembly and prior art valve is shown in the Litt et al U.S. Pat. No. 3,616,569 issued Nov. 2, 1971 and entitled BALLOON AND VALVE ASSEMBLIES AND SUPPLY THEREOF FOR DISPENSING MACHINE. The Jackson et al U.S. Pat. No. 2,924,041 issued Feb. 9, 1960 and entitled BALLOON is another example of the prior art. While these prior assemblies are generally effective for the purposes intended, it has been observed that they are not as effective as the valve of the present invention in terms of complexity and weight. A professional can fill a balloon faster and tie it off without a valve. The valve is only used by non-professional balloon venders. Furthermore, under some filling conditions, these prior valves tend to squeal which is objectionable.

The present invention provides a valve which is of relatively simplified construction so that it can be manufactured easily and economically. The valve has means for securely holding it in the neck of the balloon in a manner whereby it resists separation when being inflated. The valve is also characterized by a novel port arrangement which minimizes fluttering and squealing during the filling process. The valve also lends itself to filling through conventional valves of various sizes. The valve of the present invention is designed for use by street vendors and the like generally considered as non-professional balloon vendors. The balloons in many cases are purchased for small children. It has been found that prior valves tend to squeal during the helium filling process and this tends to frighten children to a point where they associate bad things with the balloon and therefore, do not want it. The valve of the present invention elminates this problem. Additionally, it has been found that filling balloons at high pressure, about 60 psi, intensifies the shrieking, squealing problem. It can be readily understood that persons filling large quantities for balloon release events can only sustain the shrill sounds for short periods of time.

The valve also has other desirable features. It can be made in a simple molding operation, is only one piece and therefore, is economical. It is lightweight, has no moving parts and can be used easily by very inexperienced persons. The valve has other uses such as inflating swimming pools or the like where filling is accomplished when air pressure is one and when pressure is turned off, there is no back flow.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
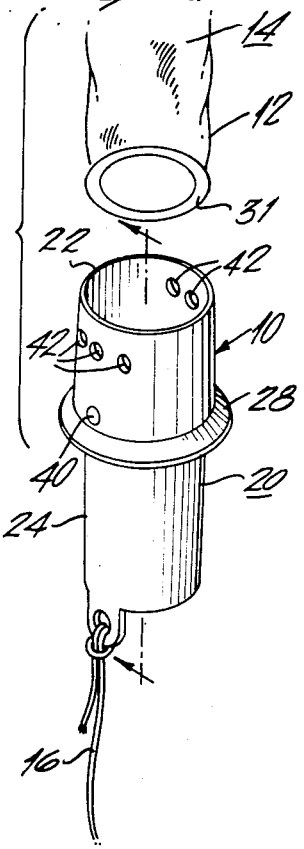
FIG. 1 is a perspective view of a valve constructed in accordance with the present invention prior to application to the neck of a balloon.
Figure 2:
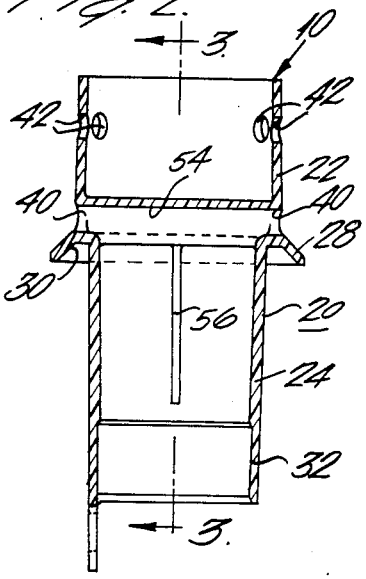
FIG. 2 is a sectional view taken on lines 2—2 of FIG. 1.
Figure 3:
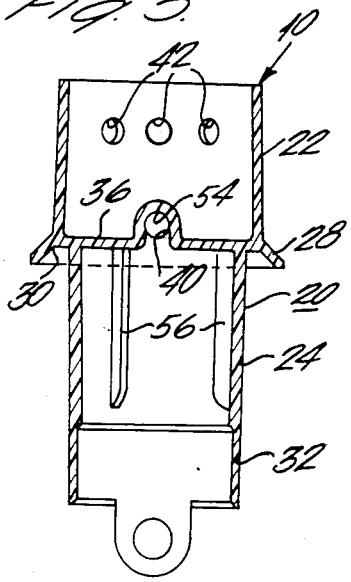
FIG. 3 is an enlarged sectional view taken on lines 3—3 of FIG. 2.

Referring now to the drawing, there is illustrated a valve for filling balloons constructed in accordance with the present invention. The valve which is designated generally by the numeral 10 is adapted to be inserted into the neck 12 of a conventional balloon 14 so that it can be inflated to full size. The valve 10 retains the balloon in its inflated condition after the balloon has been inflated by gases under pressure such as a mixture of helium and air introduced into the balloon through the valve. Note that one end of the valve has means for securing a string 16 or the like thereby providing means by which the inflated balloon may be held by the user.

Figure 4:
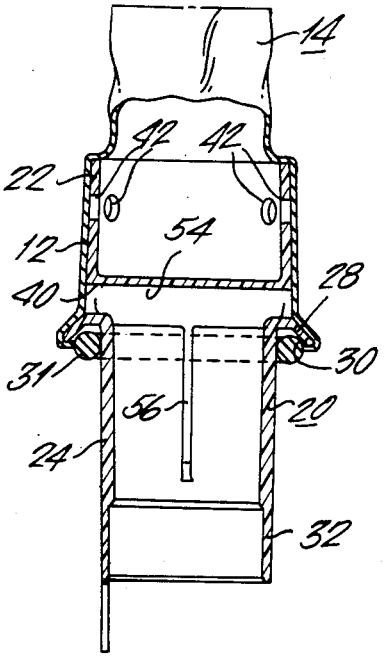
FIG. 4 is a longitudinal sectional view of the valve showing the neck of the balloon mounted in place on the valve prior to filling.

The valve 10, as illustrated, comprises an elongated, generally cylindrical body 20 which may be made by conventional molding process of a plastic material and is divided into an upper gas delivery section 22 and a lower gas supply section 24 at approximately its midpoint. The upper and lower sections are divided by a radially outwardly directed lip or flange 28 which is preferably an outwardly and downwardly depending frusto-conical lip or flange which forms an annular seat or pocket 30 to receive the bead 31 adjacent the outer terminal end of the neck 12 of the balloon to retain the balloon in place on the upper section of the valve in the manner shown in FIGS. 4–6 inclusive.

Figure 5:
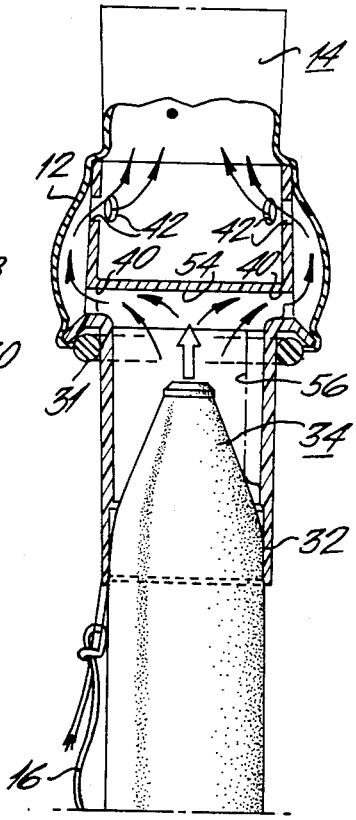
FIG. 5 is a view similar to FIG. 4 showing the flow of gas during the filling process.
Figure 6:
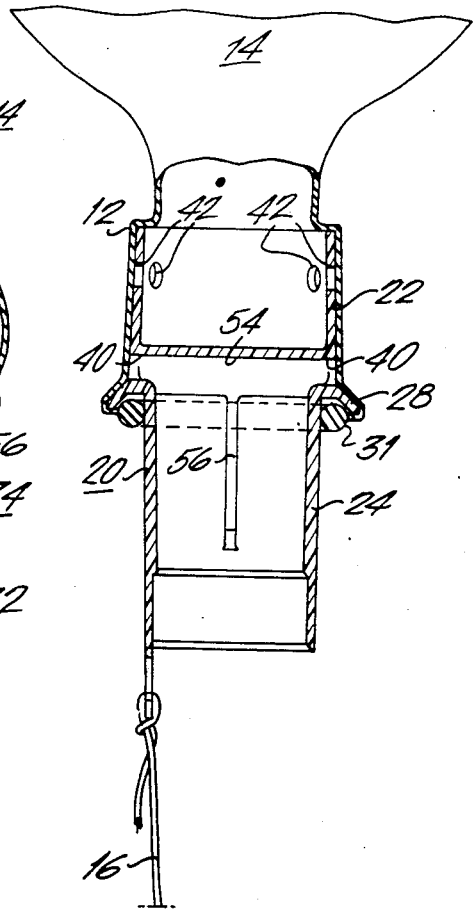
FIG. 6 is a transverse sectional view showing the balloon mounted in place on the valve and fully inflated.

The side wall of the lower section adjacent its lower free terminal end is of reduced cross section as at 32 to provide a more flexible area to snugly embrace the shaped gas supply valve head 34 which is typical of the filling heads utilized to fill the balloons. The upper and lower sections are divided by a transversely extending wall 36 which is generally aligned with the radially outwardly directed frusto-conical flange. A pair of diametrically opposed ports or openings 40 is provided in the side wall of the upper section 22 which, as illustrated, communicate with the lower section to act as a conduit for gas from the supply source to direct it from interiorly of the valve to the flexible toroidal-shaped manifold formed by the pressurized, expanding balloon neck 12, as illustrated in FIG. 5, which redirects the gas flow through the series of ports or openings 42 in the side wall of the upper section 22, ultimately filling the balloon body, openings 42 are spaced downwardly from the upper terminal edge and in the present instance are six in number.

In accordance with the present invention, the particular configuration, orientation and arrangement of the openings 42 and ports 40 are instrumental in eliminating chattering and undesirable squealing during a balloon filling operation. More specifically, it has been found that the openings or ports 42 are spaced downwardly from the upper edge of the upper section a predetermined distance, preferably at least 3/32 inches. It has been observed that the total area of the ports 40 is about 0.009 inches$^2$ and that the total area of the ports 42 is about 0.042 inches$^2$. It is also preferred that the flow area of the ports 40 is in the range of 0.008 inches$^2$ and 0.010 inches$^2$ and the flow area of the ports 42 is in the range of 0.041 inches$^2$ and 0.046 inches$^2$. It has also been observed that chattering and attendant squealing to not occur when the flow area of the ports 42 relative to the flow area of the ports 40 is in the ratio of 4.7:1. It has been found that when the ports are disposed in the manner illustrated the desired toroidal manifold effect illustrated in FIG. 5 is achieved through the normal range of pressures that balloons are normally filled, that is 16 to 60 lb/in$^2$. Note that with this type of manifold effect, the neck of the balloon snugly embraces the side wall of the upper section of the valve in the region above the ports 42 thereby preventing chattering and the consequent objectionable squealing during the filling operation.

Note that the base wall 36 is aligned with the exterior flange and has a raised radially extending section 50 defining a cross manifold 54 for the lower ports 40. A series of circumferentially spaced, axially extending ribs 56 are provided on the interior of the base section which serve to prevent the gas nozzle from actually making contact with cross channel 54 and destroying gas flow. They are in effect nozzle stops to prevent the inexperienced vendor from forcing the gas injection nozzle too far into the valve.

While a particular embodiment of the invention has been illustrated and described herein, it is not intended to limit the invention and changes and modifications may be made therein within the scope of the following claims.

What is claimed is:

1. In combination, a balloon having a neck with an opening and a valve assembly for filling the balloon positioned in said neck, said valve comprising an elongated generally tubular body member having an upper section and a lower section divided by a transverse interior wall, a radially outwardly directed frusto-conical flange diverging downward toward the lower edge of the lower section forming a seal with the bead at the mouth of the balloon, means defining at least one port communication with the lower section and located above said flange and at least one opening in the side wall of the upper section spaced downwardly from the upper terminal edge thereof a predetermined distance, the ratio of the area of the upper opening to the lower port being about 5:1, said balloon neck snugly embracing the exterior of said valve and normally preventing flow between said lower port and upper opening and during filling defining an air chamber between said balloon neck and valve having two axially spaced annular seals between the balloon neck and said flange and upper terminal edge.

2. A combination as claimed in claim 1, including a series of circumferentially spaced, axially extending ribs on the interior wall of the lower section.

3. A valve as claimed in claim 1 wherein the side wall of the lower section is stepped and of smaller cross section adjacent the lower portion thereof.

* * * * *